United States Patent [19]

Miyamoto

[11] 4,208,557

[45] Jun. 17, 1980

[54] SWITCHES

[76] Inventor: Motomu Miyamoto, 108 House Toritsudai 12-21, 2-Chome, Nakane, Meguro-Ku Tokyo 152, Japan

[21] Appl. No.: 932,952

[22] Filed: Aug. 11, 1978

[30] Foreign Application Priority Data

Aug. 12, 1977 [JP] Japan ..... 52-96615

[51] Int. Cl.[2] ..... H01H 1/28

[52] U.S. Cl. ..... 200/153 R; 200/246; 200/290

[58] Field of Search ..... 200/42 T, 42 R, 325, 200/320, 153 G, 153 K, 676, 68, 246, 283, 290, 153 L, 153 R, 339

[56] References Cited

U.S. PATENT DOCUMENTS 3,858,018 12/1974 Walley ..... 200/42 R

*Primary Examiner*—Frederick R. Schmidt

*Attorney, Agent, or Firm*—Fred Philpitt

[57] ABSTRACT

A switch for shifting between neutral, a delta three phase connection and a star three phase connection that includes three pole chambers, each pole chamber having two separate contact mechanisms, each contact mechanism being activated by means of plate springs, said plate springs being in turn activated by connection to a lever through a cross bar, control plate and bearing arrangement.

2 Claims, 10 Drawing Figures

SWITCHES

BACKGROUND OF THE INVENTION

The present invention relates to switches and more particularly to novel change-over switches used in star-delta connection.

Heretofore, as switches used in three phase connection, particularly, star-delta connection, there are various types of switches such as knife switch, star-delta actuating switch or electromagnetic switch, but the knife switch is excellent as its structure is simple and performance is excellent. However, it is of bare type and moreover it not only generates arc when a circuit changing manipulation is made but also its manipulation must be done quickly and positively otherwise it is very dangerous, and poses a problem of security. Also, the star-delta actuating switch is of tumbler type requiring complicated connection work of terminals in its assembly. Each of these switches has a serious drawback that voltage is applied on the motor even if it is in the off condition. Moreover, since the electromagnetic switch is constructed by assembling two units of three pole electromagnetic switches as the star-delta switch, it not only becomes expensive but also, required large assembly space and moreover even in the off condition, the voltage is applied to the motor, the switch is not particularly suitable for use with 400 volts, and simultaneously, the mechanical locking is difficult which are the drawbacks of the electromagnetic switch.

SUMMARY OF THE INVENTION

An object of the present invention is to provide a switch capable of operating movable contacts by resilient force of a plate spring and achieving making and breaking operation at high speed which results in quick making and breaking of contacts.

Another object of the present invention is to provide a switch wherein the plate spring is applied with pressure from the top portion by means of a cross bar to impart large margin in a stroke of manipulating lever and as a result, the making and breaking manipulation of the contacts can be achieved extremely positively and safely.

A further object of the present invention is to provide a switch having extremely high stability and product quality wherein the movable contacts are operated by the resilient force of the plate spring and the making and breaking speed of the contacts is made extremely high speed, and therefore is suitable for use in wide range, namely, from small capacity to extremely large capacity.

A still further object of the present invention is to provide a switch which becomes an optimum switch when used with 400 volts since the voltage is not applied to the motor in the off condition.

A more specific object of the present invention is to provide a switch which can be used in various ways such as a star-delta switch formed by three sets of plural contacts and 2 block type, and single-pole, double-pole switch, and triple-pole switch.

A particular object of the present invention is to provide a switch provided with an erroneous manipulation preventing mechanism wherein the manipulating lever can be locked at respective positions, star, off, delta and at the same time, the shift from the off position to the delta side can be completely prevented unless otherwise the lock is released, and as a result, the erroneous manipulation will never occur.

Another and more particular object of the present invention is to provide an extremely simplified switch which is materialized by reducing the entire shape of the switches and breakers greatly and the number of parts incorporated whereby the assemblying operation becomes extremely easy and simple.

DETAILED DESCRIPTION OF THE INVENTION

Figure 1:
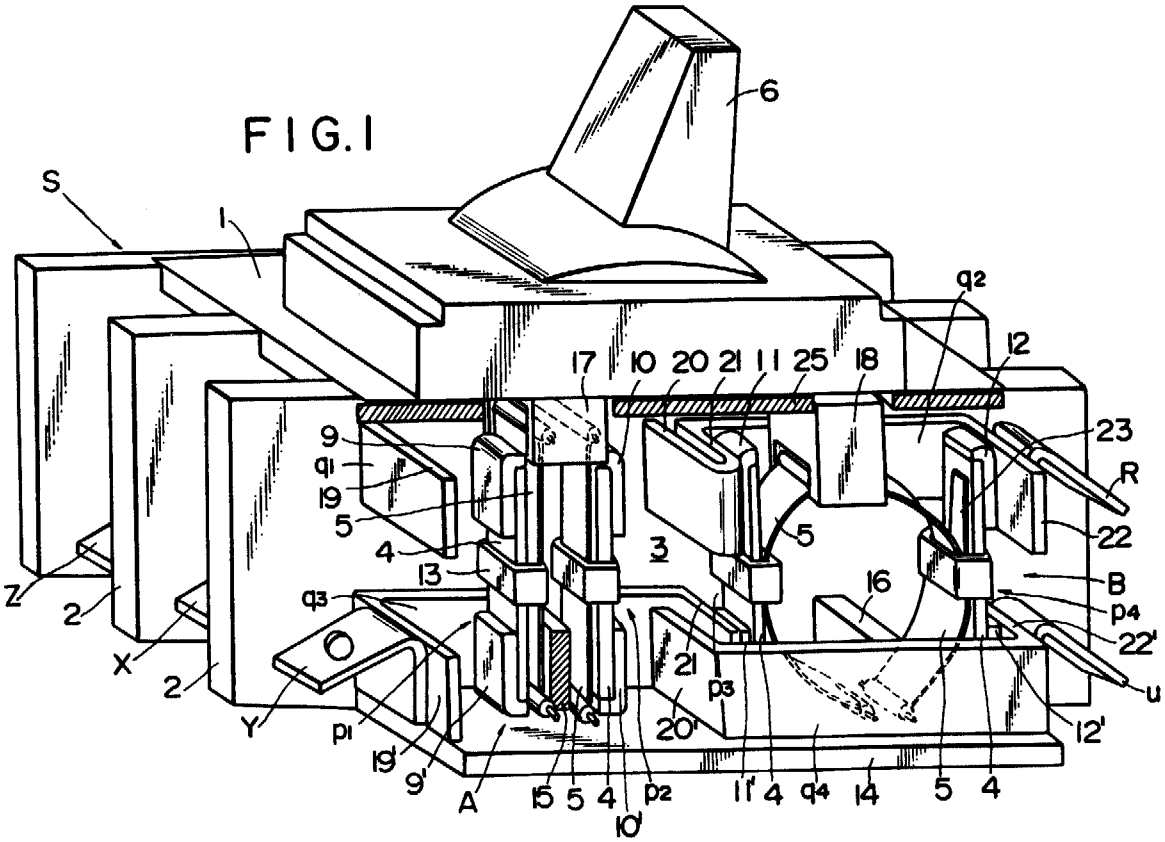
FIG. 1 is a perspective view of a switch with star-delta connection which shows a pole chamber by cutting away a front wall.
Figure 2:
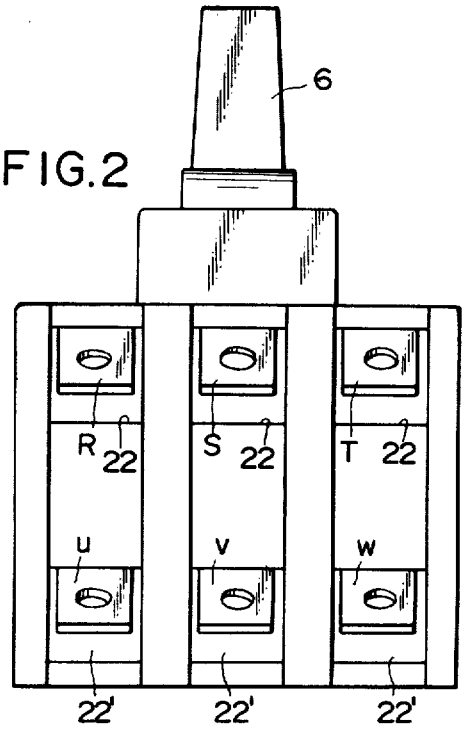
FIG. 2 is its side view.

The switch according to the present invention is shown by ordinary letters S, and the inside of the casing 1 is separated into three pole chambers of thin layers in vertical split form by means of a bulkhead 2, and a contact A for star connection and a contact B for delta connection are disposed at right and left parts of each pole chamber 3, and the contacts A and B, as shown in FIG. 1 and FIG. 2, are formed by assembling movable contacts $P_1$, $P_2$, $P_3$ and $P_4$ formed to operate a long plate 4 by the resilient force of a long plate spring 5 disposed at the back of the long plate 4, a conductive portion formed by bending a conductive long plate member, and fixed contacts $q_1$, $q_2$, $q_3$, $q_4$ formed to be integral with the contact member portion, and a manipulating lever 6 is composed of cross bars 7 and 8 for operating the movable contacts $P_1$, $P_2$, $P_3$, $P_4$ by being interlocked with the tilting operation of the manipulating lever 6 and an erroneous manipulation preventing mechanism.

The contact A for star connection and the contact B for delta connection are so formed that the contact A for star connection is formed by using the movable contacts $P_1$ and $P_2$ as one set with two sheets of long plates 4 being disposed perpendicularly in back-to-back relation, and the contact B for delta connection is formed by using the movable contacts $P_3$ and $P_4$ as one set, and the movable contact members 9, 9', 10, 10', 11, 11', 12, 12' are fixed to the top and bottom of each long plate 4. The plate spring 5 is slidably embraced by a holder 13 in the center portion of the long plate 4. The plate spring 5 is fixed pivotally at the bottom with separating members 15 and 16 rising integrally with a bottom wall 14 of the casing 1 as the border for each contact A for star and B for delta connections, and is fixed pivotally at the upper end with pressing members 17 and 18 of each cross bar 7, 8 of the star side and the delta side provided with the manipualting lever 6.

The fixed contacts $q_1$, $q_2$, $q_3$ and $q_4$ are connected by means of a plurality of contactors by fixing fixed contact members 19, 19', 20, 20', 21, 21', 22, 22' at positions corresponding to each contact member 9-12 and 9'-12' of the movable contacts $P_1$-$P_4$, namely, the top and bottom portions of the star side and the delta side of three pieces of each pole chamber.

Figure 3:
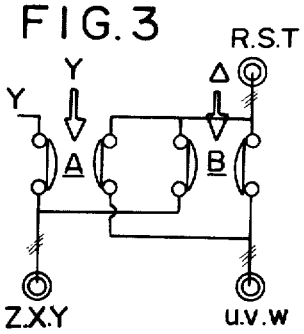
FIG. 3 is a wiring diagram showing the assembly condition of the fixed contacts in the star-delta connection in one pole chamber.
Figure 4:
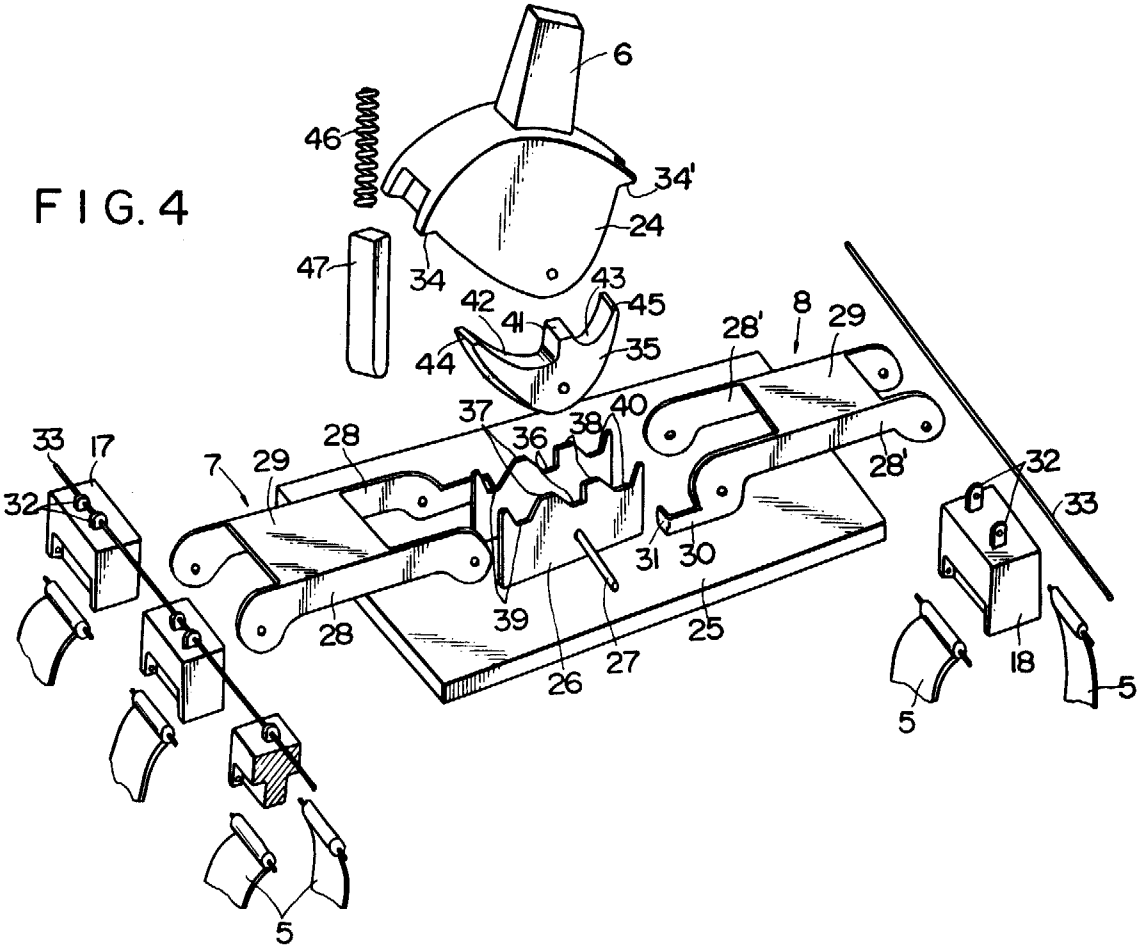
FIG. 4 is a blow-up perspective view showing an operating lever and its manipulating mechanism.
Figure 5:
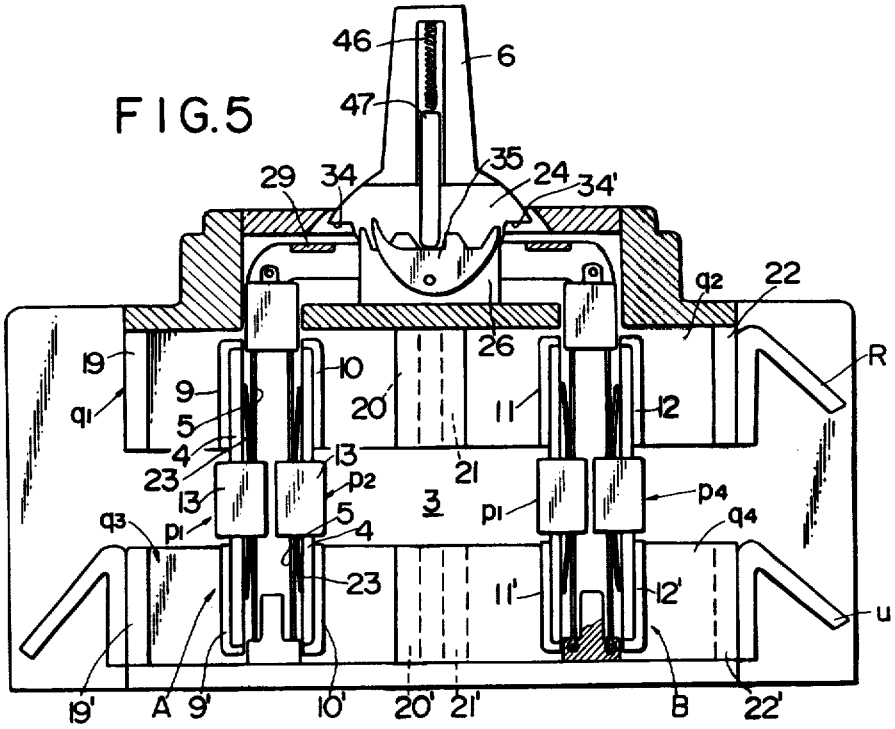
FIG. 5 is a vertical cross section showing relationship between the pole chamber and the manipulating mechanism by positioning the movable contacts in the off condition.
Figure 6:
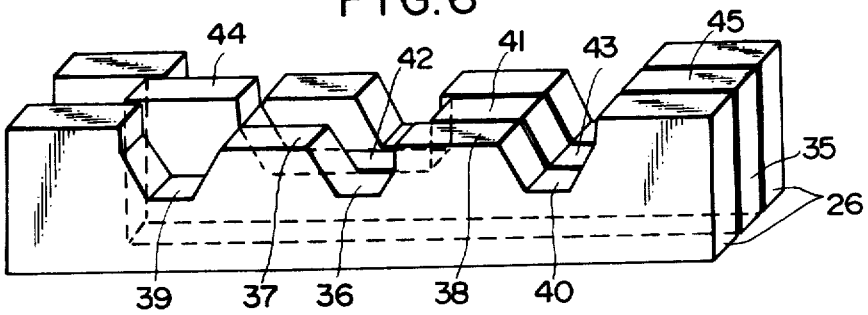
FIG. 6 is a perspective view of an erroneous manipulation preventing mechanism showing the control plate being located at a neutral position.
Figure 7:
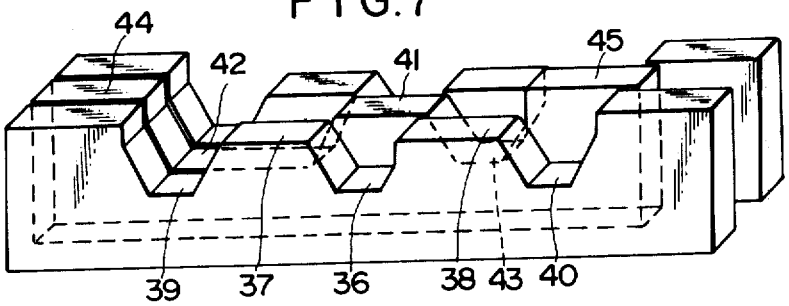
FIG. 7 is a perspective view of an erroneous manipulation preventing mechanism showing the control plate being located at the star side.

Terminals R, S and T connected to the power source are respectively installed on the fixed contact member 22 of the top portion of the outside of the delta side of each pole chamber 3, and load terminals U, V and W are respectively installed on the fixed contacts 22' of the bottom portion of the outside of the delta side of each pole chamber 3, and load terminals Y, X, Z are respectively installed to the terminal 19' of the bottom portion of the outside of the star side of each pole chamber 3. The fixed contacts $q_1$-$q_4$ are integrally formed with the respective fixed contact members 19-22 and 19'-22', namely the conductive portion and contact member portion by bending the conductive long plate member optionally as shown in FIG. 1, and the assembly is disposed in three of each pole chamber 3 to form the star-delta connection as shown in FIG. 3. Namely, the fixed contact $q_1$ is formed of elongate shape and the fixed contact member 19 is extended to the top portion of the outside of the star side of three of each pole chamber 3. and connected and energized in common, and the fixed contact $q_2$ is formed with the fixed contact members 20, 21, 22 at the star side and delta side by bending the long plate type conductive member and is provided on the top portion of the delta side of the pole chamber 3 and the power source terminals R, S, T of each pole chamber 3 is connected by the fixed contact members 22, and the fixed contact $q_3$ is provided with the fixed contact member 19' of the lower part of the outside for star connection by bending the conductive member of long plate type and the fixed contact member 21' of the bottom portion of the inside for delta in the bottom portion of the star side of each pole chamber 3, and is connected to the load terminals Z, X, Y of each pole chamber of the fixed contact member 19', and the fixed contact $q_4$ is integrally provided with the fixed contact member 20' of the bottom portion of the inside of the star connection by bending the long plate type conductive member and the fixed contact member 22' of the bottom portion of the outside for delta connection and is connected to the load terminals U, V, W by the fixed contact member 22' of each pole chamber 3. Also, the fixed contacts $q_3$ and $q_4$ are disposed to face each other at the bottom portion of the pole chamber 3, and the fixed contact member 21' of the fixed contact $q_3$ and the fixed contact member 20' of the fixed contact $q_4$ are provided at alternate positions.

The movable contacts $P_1$-$P_4$ has a plate spring 23 for pressure holding on the back of each long plate 4.

The manipulating lever 6 is provided with a projected leg portion 24 extending downwardly integrally in fork shape, and rides over a bearing 26 provided in the center portion of a cover plate 25 of the casing 1, and is pivotally installed by a pivot 27. The cross bars 7, 8 are formed by connecting two pieces of arm levers 28, 28' integrally by means of a back plate portion 29 at mutual top portions, and the cross bars 7, 8 are superposed at the end portions of the arm levers 28, 28' and are installed on the bearings 26 by means of the manipulating lever 6 and the pivot 27.

The cross bars 7, 8 are so constructed that at an end portion of the pivotal side of one of the opposed arm levers 28, 28, a projecting member 30 integrally extends from the one part of the lower side and a pawl member 31 is bent at the tip and the arm lever 28' of the cross bar 7 or 8 which becomes a mate is engaged liftable from the lower edge. The tip of each arm lever 28, 28' is so constructed that pressure elements 17, 18 for connecting the respective top portions of the plate springs 5 of the star side and delta side are pivotally provided with the bearings 32 which supports the shaft 33. The bulging portions 34, 34' which are integrally projected in right and left portions of the manipulating lever 6 are engaged with each back plate portion 29 of each cross bar 17, 18 installed at the star side and the delta side are applied with pressure according to the tilting motion of the manipulating lever 6 in right and left directions which applies the pressure on the plate spring 5 to curve like bow, and the movable contacts $P_1$-$P_4$ are connected to the fixed contacts $q_1$-$q_4$ whereby the making operation is achieved.

The erroneous operation preventing mechanism of the manipulating lever 6, as shown in FIGS. 4 through 7, is so constructed that a control plate 35 is inserted between the bearings 26 and is pivotally and coaxially installed with the manipulating lever 6 by the pivot 27. On the top surfaces of the bearings 26, concave portions for neutral are provided on their center portions, and a concave portion 39 for star connection and a concave portion 40 for delta connection are provided by means of tooth height portions 37, 38 at right and left sides of the concave portions 36. On the top surface of the control plate 35, a tooth groove 42 for star connection and a tooth groove 43 for delta connection are provided at the right and left by sandwiching the center tooth portion 41 having a height identical with the tooth height portions 37 and 38 of the bearings 26, and tooth portions 44, 45 at both ends of each tooth groove 42, 43 for star connection and delta connection are formed to a height slightly projected from the tooth height portions 37, 38 of the bearings 26. At the inside of the manipulating lever 6, a key shaft 47 for resiliently pressing downward by a coil spring 46 is embedded to shift and its bottom portion is fitted to the concave portions 36, 39, 40 of the bearings 26. The concave portion 36 for neutral of the bearing 26 is moderately inclined to the star connection side, and the concave portion 39 for star connection and concave portion 40 for delta connection are moderately inclined to the side of the concave portion 36 for neutral, and the center tooth portion 41 of the control plate 35 is formed with a moderate inclined portion to the side of the tooth groove 43 for delta connection, and the side of the tooth groove 42 for star connection is made in vertical form. When the control plate 35 is inclined to the star connection side and the tooth groove 42 for star connection is superposed with the concave portion 39 for star connection of the bearings 26, the tooth portion 41 of the control plate 35 is positioned at the concave portion 36 for neutral of the bearings 26. On the contrary, when the control plate 35 is inclined to the delta side and the tooth groove 43 for delta connection is superposed with the concave portion 40 for delta connection of the bearings 26, the center tooth portion 41 of the control plate 35 is superposed on the tooth height portion 38 of the delta connection side of the bearings 26, and the tooth portion 42 for star connection of the control plate 35 and the concave portion 36 for neutral of the bearings 26 are superposed.

Accordingly, in the off condition, a key shaft 47 of the manipulating lever 6 is fitted and positioned on the concave portion 36 for neutral of the bearings 26. Each plate spring 5 is of linear type and the movable contacts $P_1$-$P_4$ assemble the center portion for each contact A for star connection and a contact B for delta connection. When the motor (not shown in the drawing) is started, the manipulating lever is in tilt to the side of the contact A for star connection, the cross bar 7 applies the pressure to the plate spring 5 of the movable contacts $P_1$, $P_2$ by the pressing member 17, and the plate spring 5 is curved in bow shape in right and left directions, and the movable contacts $P_1$ and $P_2$ are caused to contact the respective fixed contact members 19, 19', 20, 20' by the resilient force of the plate spring 5, and the contact for star connection is connected, and the actuating current is made to flow from the terminals R, S, T to the terminals U, V, W. Next, when the switch is changed over to the contact B for delta connection, the manipulating lever 6 is in tilt to the side of the contact B for delta connection, and the pressing member 18 of the cross bar 8 applies the pressure to the plate spring 5 of the movable contacts $P_3$, $P_4$, and the movable contacts $P_3$, $P_3$ are made to contact the fixed contact members 21, 21', 22, 22' by the resilient force of the plate spring 5 similar to the case of the contact A for star connection, whereby the contact B for delta connection is connected and the rotating current flows from the terminals R, S, T to the terminals U, V, W. When the manipulating lever 6 is turned to the side of the contact B for delta connection, the pawl member 31 of the projecting member 30 provided on the arm lever 28 of the cross bar 8 of the delta side lifts the arm lever 28' of the cross bar 7 of the side of the contact A for star connection whereby the cross bar 7 of the star side is lifted upward, and the pressing force of the plate spring 5 of the movable contacts $P_1$, $P_2$ is released, and the plate spring 5 is caused to separate the movable contacts $P_1$, $P_2$ from the fixed contact members 19, 19', 20, 20' by the restoring force, and the contact A for star connection is broken. Moreover, when the motor is to be stopped, the key shaft 47 of the manipulating lever 6 is pulled to the off position, namely, toward the concave portion 36 for neutral of the bearing 36, the movable contacts $P_3$, $P_4$ are drawn toward the center portion by the restoring force of the plate spring 5, and are caused to separate from the fixed contact members 21, 21', 22, 22' to break the contact B for delta connection. Moreover, when the key shaft 47 of the manipulating lever 6 is located at the off position, namely, it is fitted to the concave portion 36 for neutral of the bearings 26, the center tooth portion 41 of the control plate 35 is superposed on the tooth height portion 38 of the delta connection side of the bearings 26, and yet, the center tooth portion 41 forms the star connection side perpendicularly so that the key shaft 47 is completely prevented from shifting to the delta side. Therefore, the making manipulation from the off position to the contact B for delta connection is absolutely impossible. Next, when the manipulating lever 6 is in tilt to the star connection side from the off position, the concave portion 36 for neutral is in tilt moderately to the star connection side, so that the key shaft 47 fitted to the concave portion 36 for neutral resists to the coil spring 46 and rides over the tooth height portion 37 of the star side, and at the same time, is engaged with the tooth portion 44 of the star connection side of the control plate 35 projecting upward of the tooth height portion 37 and while rotating the control plate 35, it fits the concave portion 39 for star connection of the bearings 26, and the contact A for star connection is energized. At this time, the tooth groove 42 for star connection of the control plate 35 is superposed on the concave portion 39 for star connection of the bearing 35, and at the same time, the center tooth portion 41 is positioned at the concave portion 36 for neutral.

In order ot shift the key shaft 47 from the concave portion 39 for star connection to the concave portion 40 for delta connection, the manipulating lever 6 is in tilt to the delta side, as each delta side of the concave portion 39 for star connection of the bearings 26 and the tooth groove 42 for star connection of the control plate 35 are inclined moderately, the key groove 47 rides over the tooth height portion 37 by resisting to the coil spring 46. The concave portion 36 for neutral of the bearings 26 is in the condition where it is buried with the center tooth portion 41 of the control plate 35, the key shaft 47 riding over the tooth height portion 37 crosses over the center tooth portion 41 without falling the concave portion 36 for neutral, and shifts to the tooth height portion 38 of the delta side, and at the same time, engages with the tooth portion 45 of the delta side of the control plate 35 and while turning the control plate 35 to the delta side, it fits to the concave portion 40 for delta connection to connect the contact B for delta connection. In this condition, the tooth groove 43 for delta connection of the control plate 35 is superposed on the concave portion 40 for delta connection, and at the same time, the center tooth portion 41 is superposed on the tooth height portion 38 of the delta side to release the concave portion 36 for neutral. And then, the manipulating lever 6 is manipulated to the off position from the position of the contact B for delta connection, the concave portion 40 for delta connection and the tooth groove 43 are moderately inclined to the star side so that the key shaft 47 rides over the tooth height portion 38 and is fitted to the concave portion 36 for neutral.

Figure 8:
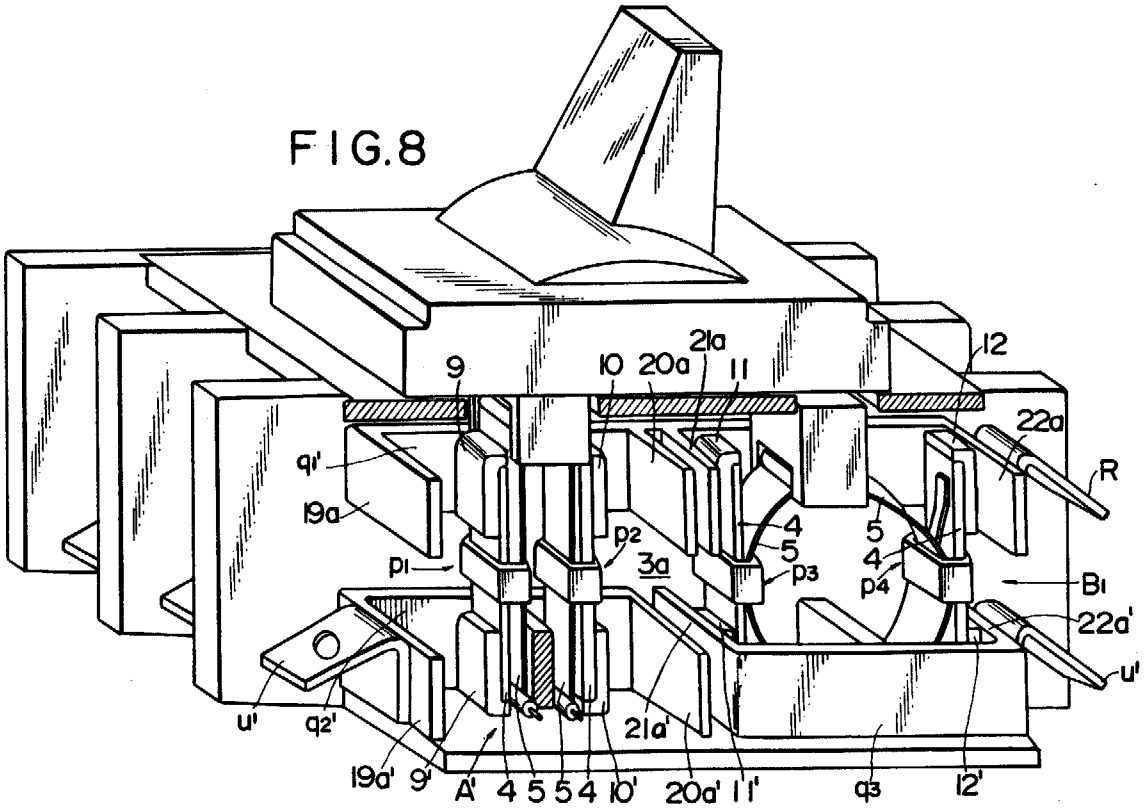
FIG. 8 shows another embodiment of the present invention and is a perspective view showing assembled condition of the fixed contacts in case it is used as the triple-pole switch.
Figure 9:
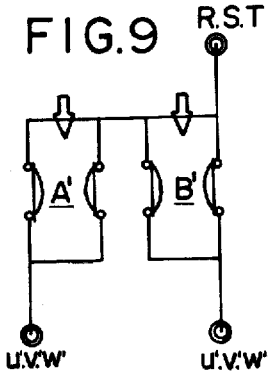
FIG. 9 is a wiring diagram showing the condition where the fixed contacts are assembled as the triple-pole switch.
Figure 10:
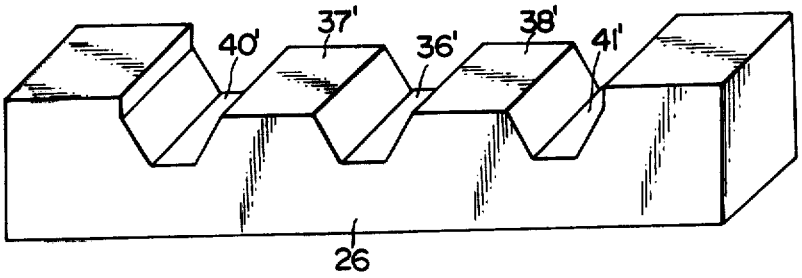
FIG. 10 is a perspective view showing a bearing of the manipulating lever in case it is used as the triple-pole switch.

By the way, FIG. 8 and FIG. 10 show another embodiment of the present invention, and FIG. 8 shows an assembly of the fixed contacts in case it is applied to the triple-pole change-over switch. Namely, in each pole chamber **3*a* which are vertically partitioned into three layers, a first contact A' and a second contact B' are disposed at right and left positions which are divided by the center, and the first contact A' and second contact B' operate by the plate spring 5' smaller to the case of the star-delta connection, and the movable contacts $P_1$-$P_4$ using the movable contact member 9-12 and 9'-12' at each top and bottom as plural contactors are provided, and on the top portion of each pole chamber 3*a*, as shown in FIG. 8, both ends are bent from the linear conductor extending to the entire length of the pole chamber 3*a* to provide the fixed contact members 19*a* and 22*a*, and two fixed contact members 20*a* and 21*b* are integrally projected in the center, so that the fixed contact $q'_1$ which becomes a common conductor of the first and second contacts A' and B' is formed, and is connected to the terminals R, S, T for power source by means of the fixed contact member 22*a*** of the top of the outside of the second contact B, and at the bottom portion of the pole chamber 3a, both ends of the linear conductor are bent to form a fixed contact $q'_2$ having the fixed contact members 19a' and 20a' and to form a fixed contact $q'_3$ having the fixed contact members 21a' and 22a', and are installed on the first and second contacts, and each terminal is connected to the load terminals U', V', W' whereby the assembly is completed. The making mechanism, as shown in FIG. 10, the concave portion 36' for neutral is set in the center on the top surface of the bearing 26, and the concave portion 39' for first contact and the concave portion 40' for second contact are formed by means of the tooth height portions 37' and 38' at its right and left, and are formed with an inclination so that the key shaft 47 can be freely shifted and fitted with each concave portion 36', 39' and 40'.

What is claimed is:

1. A switch comprising in combination:

(a) a casing (b) partition members dividing said casing into three pole chambers, (c) each pole chamber containing a first contact mechanism for a star three phase connection and a second contact mechanism for a delta three phase connection, (d) each contact mechanism comprising a pair of spaced apart interior contact members and a pair of spaced apart exterior contact members, (e) each pair of interior contact members being composed of a pair of vertically disposed spaced apart plates, (f) a pair of vertically disposed plate springs located between each pair of spaced apart interior contact members, each plate spring being connected intermediate its ends to a vertically disposed plate at a point intermediate its ends, the lower ends of said plate springs being connected to the lower part of said casing, (g) the upper and lower outwardly facing ends of each of said vertically disposed plates being provided with a contact surface, (h) each pair of exterior contact members being provided with spaced apart contact areas that are adapted be contacted by a contact surface of a vertically disposed plate, (i) a vertically movable pressing member attached to the upper ends of each pair of vertically disposed plate springs, which pressing member is adapted to bow its attached plate springs outwardly when pressed downwardly, (j) a manipulating lever that extends partially outside said casing and partly inside said casing, (k) a cross bar arrangement connected to the tops of all of said vertically movable pressing members, (l) a control plate and bearing arrangement interconnecting said cross bar arrangement with said manipulating lever so that the movement of the manipulating lever from one position to another will either (1) depress one set of pressing members, which in turn will cause the plate springs attached to said set of pressing members to bow outwardly and establish conductive contact between the outwardly facing ends of the vertically disposed plates of said first contact mechanism with the spaced apart contact areas of the exterior contact members of said first contact mechanism, thus establishing a star three phase connection, or (2) depress another set of pressing members which in turn will cause the plate springs attached to said set of pressing members to bow outwardly and establish conductive contact between the outwardly facing ends of the vertically disposed plates of said contact mechanism with the spaced apart contact areas of the exterior contact members of said second contact members, thus establishing a delta three phase connection, or (3) depress none of the pressing members so that the switch is in a neutral position.

2. A switch according to claim 1 wherein said control plate is pivotally installed adjacent the lower part of the manipulating lever, said bearing having a first central concave portion which serves as the neutral position for the lever, a concave portion adjacent said central concave portion which serves as the star connection position of the lever, a concave portion on the outer side of said central concave portion which serves as a delta connection position, said manipulating lever being formed with a forklike leg member that rides over the bearings so as to be pivotally installed, a key shaft buried inside said lever so as to be resiliently moved downward by a spring, the tip of the key shaft being pressure engaged on the bearing and the upper edge of the control plate, said concave portion for the star connection and said concave portion for the delta connection being formed with moderate inclination to the side of the neutral concave portion, a center tooth portion on the control plate being formed so that the side of the tooth groove for the star connection is made perpendicular and the side of the tooth groove for delta connection is inclined moderately, and when the tooth portion for star connection of the control plate is superposed with the concave portion for the star connection of the bearings, the center tooth portion of the control plate is positioned at the neutral concave portion of the bearings, and when the center tooth portion of the control plate is superposed on the tooth portion of the delta side of the bearings, the center tooth portion of the control plate is superposed on the tooth height portion of the delta side of the bearings, and when the tip of the key shaft shifts from the concave portion for star connection of the bearings to the concave portion for delta connection, the concave portion for netural is closed at the center tooth portion of the control plate, and when the key shaft is at the concave portion for delta connection of the bearings, the concave portion for neutral is released.

* * * * *